US007687698B2

(12) United States Patent
Kim

(10) Patent No.: US 7,687,698 B2
(45) Date of Patent: Mar. 30, 2010

(54) APPARATUS FOR ADJUSTING NECK ANGLE OF GUITAR

(76) Inventor: Jong Hoon Kim, #1907 Daerim Acrotel, 467-6, Dogok-dong Gangnam-gu, Seoul (KR) 135-971

( * ) Notice: Subject to any disclaimer, the term of this patent is extended or adjusted under 35 U.S.C. 154(b) by 0 days.

(21) Appl. No.: 12/365,555

(22) Filed: Feb. 4, 2009

(65) Prior Publication Data

US 2010/0024623 A1 Feb. 4, 2010

(30) Foreign Application Priority Data

Aug. 4, 2008 (KR) ..... 10-2008-0076107

(51) Int. Cl.
*G10D 3/00* (2006.01)

(52) U.S. Cl. ..... 84/293; 84/267; 84/291

(58) Field of Classification Search ..... 84/293, 84/267, 291

See application file for complete search history.

(56) References Cited

U.S. PATENT DOCUMENTS 538,205 A * 4/1895 Back ..... 84/293
1,707,192 A * 3/1929 Overton ..... 84/267
1,755,019 A * 4/1930 Parker, Jr. ..... 84/293
1,785,266 A * 12/1930 Lange ..... 84/293
1,818,631 A * 8/1931 Larson ..... 84/293

(Continued)

FOREIGN PATENT DOCUMENTS

KR 100201770 B1 3/1999

(Continued)

*Primary Examiner*—Jeffrey Donels
*Assistant Examiner*—Robert W Horn
(74) *Attorney, Agent, or Firm*—Grant D. Kang; Kang Intellectual Property Law, LLC

(57) ABSTRACT

Disclosed is an apparatus for adjusting a neck angle of a guitar. The apparatus comprises a support block having a receiving groove into which the neck is inserted. The support block is installed inside a lateral plate. A reinforcing plate is installed at bottom of the receiving groove of the support block. The reinforcing plate includes a central plate, a fixed plate fixed to a front face of the support block, and a guide plate guiding rotating of the neck. An adjustment device includes an adjustment bolt inserted into an adjustment hole and a thread portion formed in the adjustment hole of the central plate of the reinforcing plate so as to be thread-fastened with the adjustment bolt. A fixing device includes a fixing bolt inserted into a fixing hole and a fixing nut fixed inside the neck body and thread-fastened with the fixing bolt.

9 Claims, 6 Drawing Sheets

U.S. PATENT DOCUMENTS

| | | | | | |
|---|---|---|---|---|---|
| 3,196,730 | A | * | 7/1965 | Daniel | 84/293 |
| 3,550,496 | A | * | 12/1970 | Fender | 84/293 |
| 4,295,403 | A | * | 10/1981 | Harris | 84/293 |
| 5,353,672 | A | * | 10/1994 | Stewart | 84/291 |
| 5,679,910 | A | * | 10/1997 | Steinberger et al. | 84/291 |
| 5,786,539 | A | * | 7/1998 | Steinberger | 84/293 |
| 5,886,272 | A | * | 3/1999 | Regenberg | 84/293 |
| 5,918,299 | A | * | 6/1999 | Yui | 84/291 |
| 6,028,255 | A | * | 2/2000 | Myronyk | 84/293 |
| 6,051,766 | A | * | 4/2000 | Taylor | 84/293 |
| 6,265,648 | B1 | * | 7/2001 | Steinberger | 84/293 |
| 6,831,218 | B2 | * | 12/2004 | Steinberger | 84/293 |
| 7,157,634 | B1 | * | 1/2007 | Babicz | 84/293 |
| 7,208,664 | B1 | * | 4/2007 | Regenberg et al. | 84/267 |
| 7,326,838 | B1 | * | 2/2008 | Bunker | 84/293 |
| 7,465,859 | B2 | * | 12/2008 | Kroeger et al. | 84/293 |
| 7,518,048 | B2 | * | 4/2009 | Murray | 84/291 |
| 7,557,281 | B1 | * | 7/2009 | Campling | 84/293 |

FOREIGN PATENT DOCUMENTS

| | | |
|---|---|---|
| KR | 200239394 | 10/2001 |
| KR | 200306064 | 3/2003 |

* cited by examiner

APPARATUS FOR ADJUSTING NECK ANGLE OF GUITAR

CROSS-REFERENCE TO RELATED APPLICATIONS

This application claims priority to Korean Patent Application No. 10-2008-0076107, filed on Aug. 4, 2008.

BACKGROUND OF THE INVENTION

1. Field of the Invention

The present invention relates to an apparatus for adjusting the neck angle of a guitar, and in more particular, an apparatus for adjusting the neck angle of a guitar, in which the neck angle can be easily adjusted in order to adjust the spacing between the finger board and the guitar strings in a guitar.

2. Background of the Related Art

In general, a guitar is one of stringed musical instruments which are familiar and close to our everyday life, and is not very expensive and can be easily played, thereby having become very popular. Such a guitar is comprised of a main body, a neck connected with the main body and having a desired length, a head formed in the end portion of the neck, guitar strings, and the like.

The main body is comprised of a top plate, a back plate and a lateral plate. A sound hole is formed in the top plate. When a guitar is being played, the sound being resonated by vibration of guitar strings is produced externally through the sound hole. A bridge is installed in the top surface of the main body. A bridge pin is installed in the bridge. A saddle is provided, on which the guitar strings are rested.

The neck includes a body having a desired thickness, a finger board formed thereon, a fret installed on top of the finger board at regular intervals, a nut installed at the end portion to the head, and the like. Further, inserted inside the body is an adjust rod for preventing the neck from bending or being distorted, which may be caused by tension of the guitar strings.

The head is provided with a head machine, which is a combination of a shaft and a string-tension adjusting tool. One end of the guitar string is connected to the bridge pin, and the other end thereof is connected with the shaft of the head machine, and rested on the upper and lower saddles. The wavelength and frequency of sound depend on the length, tension and line density of the guitar string. Thus, the sound is differentiated, depending upon positions of the fret on the finger board.

On the other hand, under the changing environment such as temperature, humidity or the like, the guitar sound can become different, due to a change in the finger board of the guitar neck and the spacing between the guitar strings, because the top plate of the main body is raised up or sagged down. In a serious situation, the guitar can not be played. Thus, when the reason or weather changes, quite often it cannot be played even if it is well-tuned.

SUMMARY OF THE INVENTION

Accordingly, the present invention has been made in view of the above-mentioned problems occurring in the prior art, and it is a primary object of the present invention to provide an apparatus for adjusting the neck angle of a guitar, in which the neck angle can be easily adjusted in a simple way in order to adjust the spacing between the finger board and the guitar strings in a guitar.

To accomplish the above object of the present invention, according to one aspect of the present invention, there is provided an apparatus for adjusting a neck angle of a guitar, which includes a main body, a neck connected to one side of the main body, a head formed at an end portion of the neck, and a guitar string. The apparatus comprises: a support block having a receiving groove into which the neck is inserted, the support block being installed inside a lateral plate at a position corresponding to an aperture formed at one side of the main body; a reinforcing plate installed at bottom of the receiving groove of the support block, the reinforcing plate including a central plate, a fixed plate fixed to a front face of the support block, and a guide plate guiding rotating of the neck; an adjustment device for adjusting angle of the neck, the adjustment device including an adjustment bolt inserted into an adjustment hole formed from the bottom of the support block to the reinforcing plate and a thread portion formed in the adjustment hole of the central plate of the reinforcing plate so as to be thread-fastened with the adjustment bolt; and a fixing device for fixing the neck, the fixing device including a fixing bolt inserted into a fixing hole formed from the bottom of the support block to the neck body and a fixing nut fixed inside the neck body and thread-fastened with the fixing bolt.

In an embodiment, the reinforcing plate and the guide plate are bent along a circumferential circle R about a fixed point.

In an embodiment, a fixed protrusion to be inserted into an insert groove of the neck is raised in the central plate of the reinforcing plate.

In an embodiment, a support member for supporting the neck is installed outside the lateral plate at a position corresponding to the aperture.

In an embodiment, a support plate is installed at the bottom face of the neck.

According to another aspect of the invention, there is provided a guitar having a main body, a neck connected to one side of the main body, a head formed at an end portion of the neck, and a guitar string. The guitar comprises: an adjustment hole formed in a back plate of the main body; a hole plate installed inside the back plate at a position corresponding to the adjustment hole, the hole plate having a second adjustment hole at the center thereof, and a magnet installed inside the hole plate, wherein the adjustment hole is closed with a cover made of an iron plate.

As described above, since the neck angle adjustment according to the invention is configured such that an adjustment bolt is simply rotated to rotate the neck about a fixed point, the spacing between the finger board of the neck and the guitar string can be easily and conveniently adjusted. Thus, the guitar can be maintained at an optimum state, regardless of climates such as high- or low-temperature and humidity area.

Further, when the spacing between the finger board and the guitar string is adjusted, the neck rotates about the fixed point, the fret forming the fixed point never moves regardless of the neck movement, thereby not changing the tone of guitar. T his structure can sustain impact from any directions.

Furthermore, a guitar having the neck angle adjustment apparatus of the invention can be transported and maintained in an easy and convenient way since the neck and the main body can be simply assembled to or disassembled from each other.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Hereinafter, the preferred embodiments of the invention will be described in detail with reference to the accompanying drawings.

Figure 1:
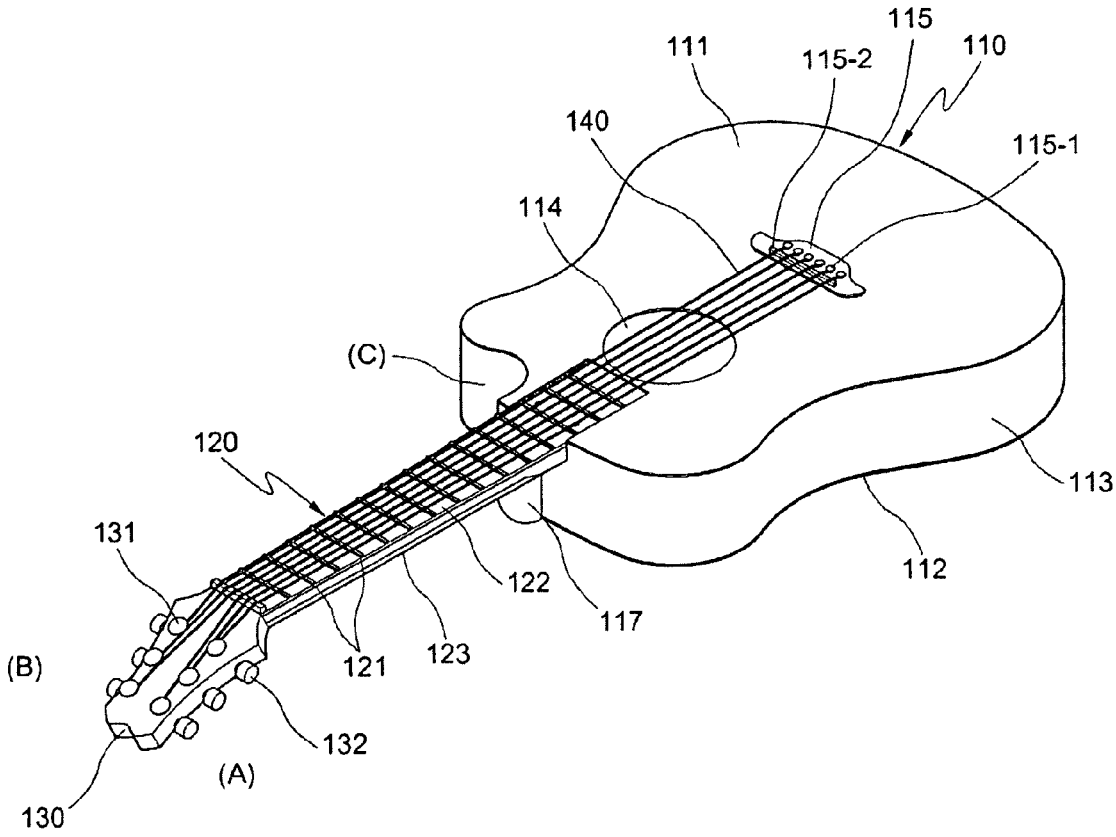
FIG. 1 is a perspective view showing a guitar having an apparatus for adjusting the neck angle according to an embodiment of the present invention.
Figure 2:
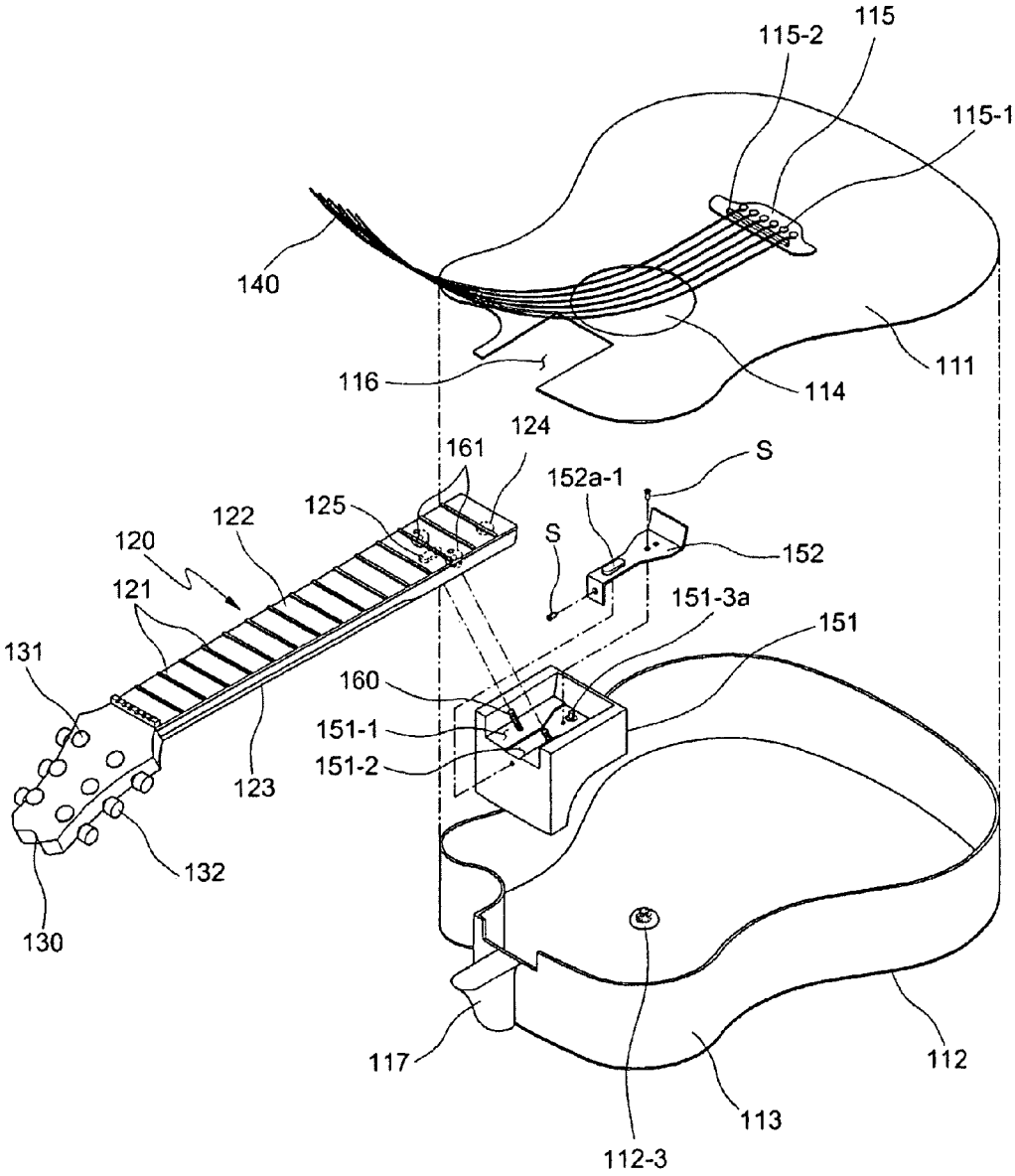
FIG. 2 is an exploded perspective view showing a guitar having an apparatus for adjusting the neck angle according to an embodiment of the invention.
Figure 3:
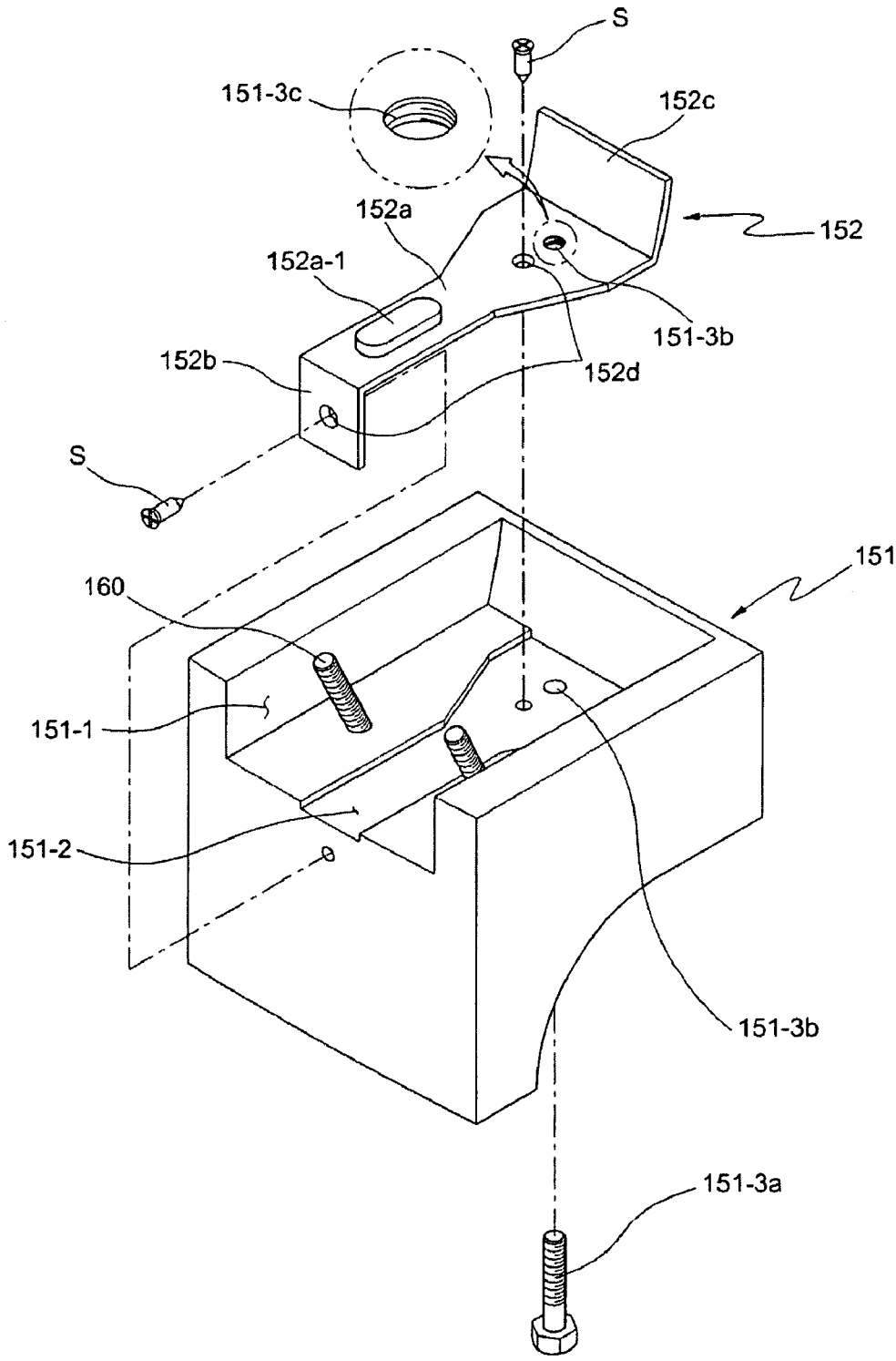
FIG. 3 is an exploded perspective view showing an apparatus for adjusting the neck angle of a guitar according to an embodiment of the invention.
Figure 4:
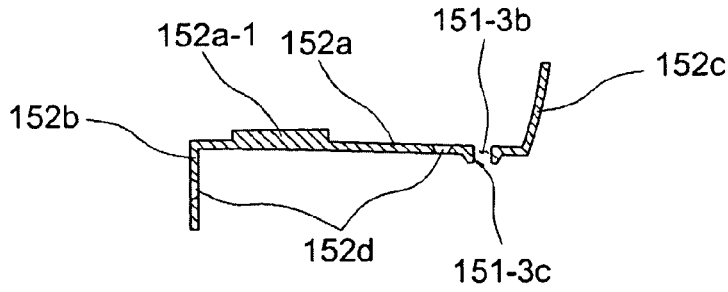
FIG. 4 is a side sectional view showing a reinforcing plate in the apparatus for adjusting the neck angle of a guitar.
Figure 5:
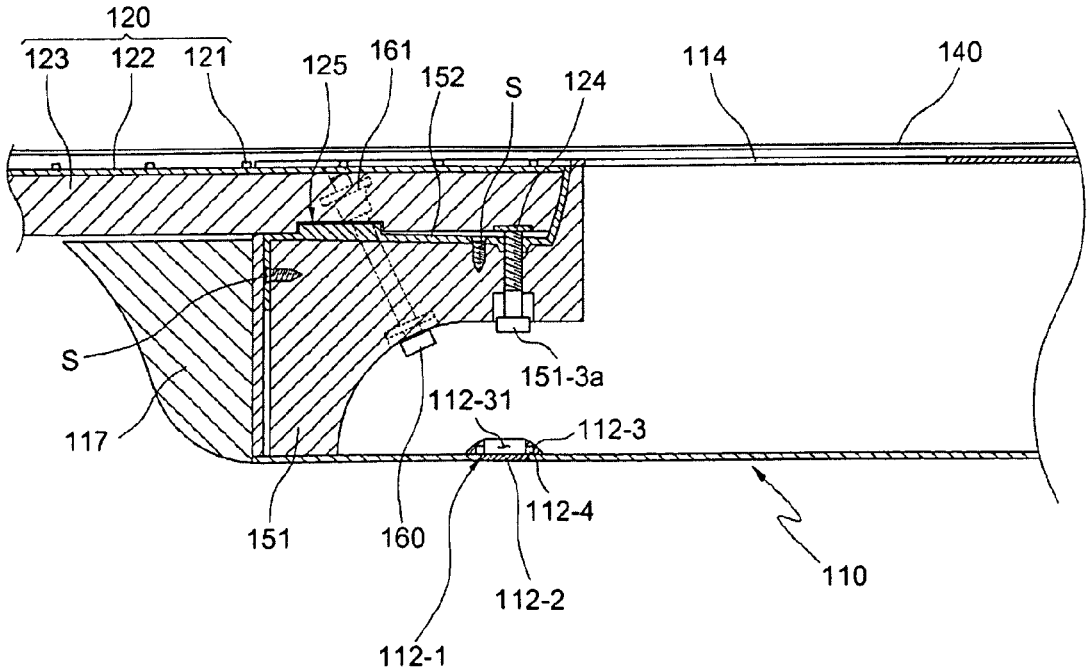
FIG. 5 is a side sectional view showing the apparatus for adjusting the neck angle of a guitar.

FIG. 1 is a perspective view showing a guitar having an apparatus for adjusting the neck angle according to an embodiment of the present invention. FIG. 2 is an exploded perspective view showing a guitar having an apparatus for adjusting the neck angle according to an embodiment of the invention. FIG. 3 is an exploded perspective view showing an apparatus for adjusting the neck angle of a guitar according to an embodiment of the invention. FIG. 4 is a side sectional view showing a reinforcing plate in the apparatus for adjusting the neck angle of a guitar. FIG. 5 is a side sectional view showing the apparatus for adjusting the neck angle of a guitar.

As illustrated in the drawings, the guitar formed with an apparatus for adjusting the neck angle according to an embodiment of the invention includes a main body 110 formed with a bridge 115 to which one end of a guitar string is fixed, a neck 120 combined to one side of the main body 110, a head 130 combined to the end portion of the neck 120, a support block 151 installed between the main body 110 and the neck 120 to adjust the neck angle, a reinforcing plate 152 installed in the support block 151, guitar strings 140, and the like.

The main body 110 is comprised of a top plate 111 having a circular sound hole 114, a back plate 112 facing the top plate 111, and a lateral plate 113 combined with edges of the top plate 111 and the back plate 112 in a way to be spaced apart from each other. Sound resonance is generated in the internal space formed by the top plate 111, back plate 112 and lateral plate 113. Further, formed in one side of the main body 110 is an aperture 116, into which the neck 120 is inserted.

An adjustment hole 112-1 is formed in the back plate 112. A hole plate 112-3 is installed at the inner side of the back plate 112 that corresponds to the adjustment hole 112-1. A second adjustment hole 112-31 is formed in the center of the hole plate 112-3. A small magnet 112-4 is installed inside the hole plate 112-3. The adjustment hole 112-1 normally remains closed with a cover 112-2 formed of an iron plate. The magnet 112-4 holds the cover 112-2 not to be easily released.

On the other hand, when the adjustment hole 112-1 is required to open in order to adjust the angle of the neck 120, a magnet stronger than the magnet 112-4, such as a magnet provided in a ranch cover, can be approached to the cover 112-2, thereby being able to pull out the cover 112-2 and thus open the adjustment hole 112-1. Details thereon will be further described hereafter.

The head 130 is formed at the end portion of the neck 120. A head machine is installed in the head 130. The head machine is a combination of a shaft 131, to which one end of the guitar string is fixed, and a tension adjustment tool 132 for adjusting tension of the guitar string.

The neck 120 is comprised of a body 123 having a considerable thickness, a finger board 122 formed on top of the body 123, a fret 121 installed on top of the finger board 122 at regular intervals, and the like. Further, installed inside the body 123 is an adjustment rod (not shown) for preventing the neck 120 from bending or being distorted by tension force of the guitar strings.

In addition, formed at the lower portion of the neck 120 are an insert groove 125, a fixing nut 161 and a support plate 124, which will be further described hereinafter. Such a guitar has different lengths, depending upon types or characteristics of the guitar. Accordingly, different numbers of the fret 121 are installed in the top face of the guitar.

On the other hand, a support block 151 is installed inside the lateral plate 113 that correspond to the aperture 116 formed in the main body 110. Installed outside the lateral plate 113 corresponding to the aperture 116 is a support member 117 for supporting the neck 120. The support block 151 is fixed to the top plate 111, back plate 112 and lateral plate 113 of the main body 110.

The support block 151 is formed with a receiving groove 151-1, into which the neck 120 is inserted. Formed in the bottom of the receiving groove 151-1 is a reinforcing plate groove 151-2, in which the reinforcing plate 152 is installed. The support block 151 is installed such that the width of its receiving groove 151-1 is aligned with the width of the aperture 116 and the bottom face of the receiving groove 151-1 is aligned with the aperture horizontal line of the lateral plate 113.

One end portion of the neck 120 is inserted into the receiving groove 151-1 to be combined with the support block 151 and the main body 110. The neck 120 is assembled with the main body 110 in such a manner that a fret 121 horizontal with the body line of the main body 110 is placed at the distal end of the main body 110. The fret 121, which is horizontal with the line of the main body 110, may be the twelfth fret, the fourteenth fret, or the sixteenth fret, depending upon the guitar. This fret is called a fixed point P.

In this way, if the fret forming the fixed point P moves, the tone is mismatched. Therefore, in a case where the neck 120 is moved in order to adjust the spacing between the finger board 112 and the guitar string 140 in the neck, the fret 121 forming the fixed point P is not to be moved.

This embodiment of invention is configured such that the fret 121 forming the fixed point P is not to be moved, even when the neck 120 is moved to adjust the spacing between the finger board 122 and the guitar string 140 in the neck. That is, when the angle of the neck 120 is adjusted to adjust the spacing, the neck 120 is coupled to the main body 110 such that the neck 120 rotates about the fixed point P. Thus, if the neck 120 is moved to adjust the angle thereof, both ends of the neck 120 moves along the circumference of a circle R about the fixed point P. In this way, since the neck 120 rotates about the fixed point P, the fret 121 forming the fixed point P never moves even though the neck 120 rotates any further.

The reinforcing plate 152 is comprised of a central plate 152*a*, a fixed plate 152*b* which is bent at one end of the central plate 152*a* and fixed to the front face of the support block 151, a guide plate 152*c* which is bent along the circumference of the circle R about the fixed point P and guides rotation of the neck 120, and a fixed protrusion 152*a*-1 raised at the one side of the central plate 152*a*.

Such a reinforcing plate 152 is inserted into and rested on the reinforcing plate groove 151-2 formed in the bottom floor of the receiving groove 151-1 of the support block 151. Then, a screw nail S is used to fix it to the support block 151 through coupling holes 152*d* perforated in the central plate 152*a* and the fixed plate 152*d* respectively. The depth of the reinforcing plate groove 151-2 is made identical to the thickness of the reinforcing plate 152, so that the bottom face of the receiving groove 151-1 is horizontal with the surface of the reinforcing plate 152.

When one end portion of the neck 120 is inserted into the receiving groove 151-1 of the support block 151 and the neck 120 is coupled with the support block 151 and the main body 110, the fixed protrusion 152*a*-1 raised at one side of the central plate 152*a* is inserted into the insert groove 125 formed at the lower portion of the neck 120.

In this way, the reinforcing plate 152 is inserted into the reinforcing plate grove 151-2 at the bottom of the receiving groove 151-1 of the support block 151. The fixed plate 152*b* is fixed to the front face of the support block 151. Further, the fixed protrusion 152*a*-1 raised in the central plate 152*a* is inserted into the insert groove 125 formed at the lower portion of the neck 120. Therefore, the neck 120 and the support block 151 are firmly connected with each other, thereby enabling to sustain impact being exerted to the right and left of the head 30.

In particular, a lengthwise impact is sustained by the reinforcing plate 152, which is firmly fixed to the support block 151 by means of the screw nail S, and a lateral impact is sustained by the fixed protrusion 152*a*-1, thereby enabling to sustain the impact in any directions. In case of a cut way guitar, as illustrated in FIG. 1, if an impact force is exerted toward the direction (B) from the direction (A) of the head 130, the portion (C) is broken so that the guitar cannot be used. However, the structure of the invention can be applied to this cut way guitar to thereby enable to use the guitar in a safe manner.

The support block 151 is equipped with an adjustment device and a fixing device. The adjustment device is to rotate the neck 120 about the fixed point P and adjust the neck angle, and the fixing device is to fix the neck at the angle-adjusted state by the adjustment device.

The adjustment device includes an adjustment bolt 151-3*a* that is inserted into the adjustment hole 151-3*b* formed vertically from the bottom face of the support block 151 to the top face of the central plate 152*a* of the reinforcing plate 152, and a thread portion 151-3*c* formed in the adjustment hole 151-3*b* of the central hole 151-3*b* of the central plate 152*a* of the reinforcing plate 152 so as to be thread-fastened with the adjustment bolt 151-3*a*. Preferably, the thread portion 151-3*c* is formed in such a way that the adjustment hole 151-3*b* portion of the central plate 152*a* is extruded downwardly to expand the thickness thereof, and then a taping process is carried out in the adjustment hole 151-3*b*.

The adjustment bolt 151-3*a* is inserted from the lower end of the adjustment hole 151-3*b* and thread-fastened with the thread portion 151-3*c* of the adjustment hole 151-3*b*. The adjustment bolt 151-3*a* is rotated until its upper end reaches the bottom face of the neck 120. Then, if the adjustment bolt 151-3*a* is rotated clockwise or counterclockwise, the neck 120 rotates about the fixed point P such that the neck angle is adjusted. As illustrated in FIGS. 2, 5, 6 and 7, the support plate 124 is installed in the bottom face of the neck 120. The fixing device is comprised of a fixing bolt 160 inserted into a fixing hole (not shown), which is formed from the bottom of the support block 151 to the neck body 123 and a fixing nut 161 thread-fastened with the fixing bolt 160. As illustrated, it is more preferable that the fixing hole is perforated with an inclination. The fixing nut 161 is fixed inside the neck body 123 such that its hole is aligned with the fixing hole.

The fixing bolt 160 is inserted from the lower end of the fixing hole formed in the support block 151 and thread-engaged with the fixing nut 161 to fasten the fixing bolt 160. Thus, the neck 120 is fixed at the angle-adjusted state. As illustrated, it is desirable that such fixing bolt 160 and fixing nut 161 are installed in duplicate in order for the neck 120 to be firmly fixed.

Figure 6:
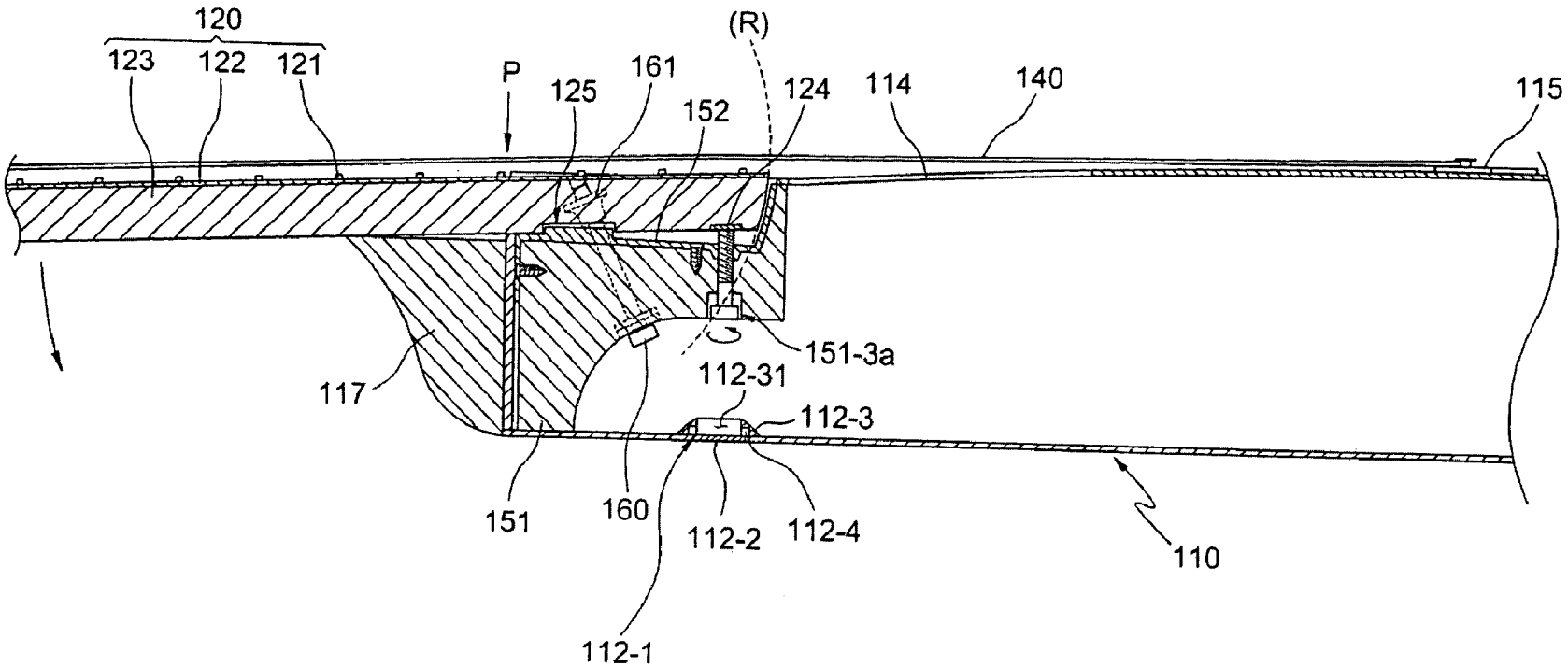
FIGS. 6 and 7 explain a method of adjusting the neck angle in a guitar having an apparatus for adjusting the neck angle according to an embodiment of the invention.
Figure 7:
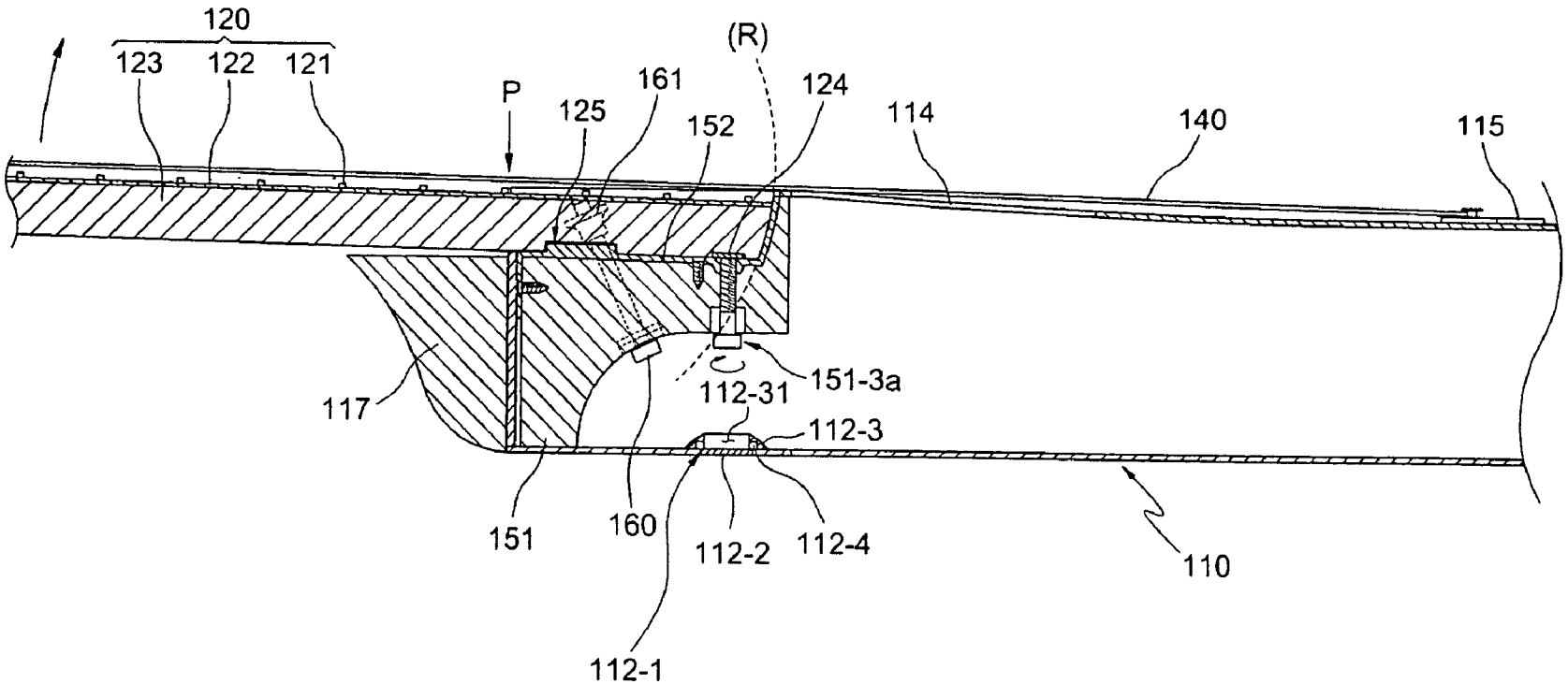

Hereafter, the above apparatus for adjusting neck angle of a guitar is used as follows. FIGS. 6 and 7 explain a method of adjusting the neck angle in a guitar having the apparatus for adjusting the neck angle.

FIG. 6 illustrates a case where the top plate 111 of the main body 110 is bent in a convex fashion due to a change in the temperature and humidity, and thus the spacing between the finger board of the neck and the guitar string became larger than normal. At this state, the cover 112-2 of the adjustment hole 112-1, which is formed in the back plate 112, is opened and the fixing bolt 160 is made loosened using an 'L' shape ranch. Then, the adjustment bolt 151-3*a* is rotated to push the neck 120 upwardly such that the neck 120 rotates about the fixed point P and thus the head 130 side goes downward, thereby narrowing the spacing between the finger board 122 and the guitar string 140. When the spacing between the finger board and the guitar string becomes appropriate, if the rotation of the adjustment bolt 151-3*a* is stopped and then the fixing bolt 160 is fastened, the neck 120 can be fixed at the adjusted state.

On the other hand, FIG. 7 illustrates a case where the top plate 111 of the main body 110 of the guitar 110 is bent in a concave fashion, and thus the spacing between the finger board of the neck and the guitar string became narrower than normal. At this state, the cover 112-2 of the adjustment hole 112-1 is opened and the fixing bolt 160 is made loosened using an 'L' shape ranch. Then, the adjustment bolt 151-3*a* is rotated to push the adjustment bolt 151-3*a* downwardly such that the neck 120 rotates about the fixed point P and thus the head 130 side goes upward by tension force of the guitar string 140, thereby increasing the spacing between the finger board 122 and the guitar string 140. When the spacing between the finger board 122 and the guitar string 140 becomes appropriate, if the rotation of the adjustment bolt 151-3*a* is stopped and then the fixing bolt 160 is fastened, the neck 120 can be fixed at the adjusted state.

As described above, since the guide plate 152*c* of the reinforcing plate 151-2 is bent upwardly along the circumference of a circle R about the fixed point, the guide plate 152*c* guides rotation of the main body 110 side end portion of the neck 120 when the neck 120 rotates about the fixed point P and the main body 110 side end portion of the neck 120 rotates along the bent inner face of the guide plate 152*c*.

In this way, since the neck angle adjustment according to the invention is configured such that an adjustment bolt is simply rotated to rotate the neck about a fixed point, the spacing between the finger board of the neck and the guitar string can be easily and conveniently adjusted. Thus, the guitar can be maintained at an optimum state, regardless of climates such as high- or low-temperature and humidity area.

Further, when the spacing between the finger board and the guitar string is adjusted, the neck rotates about the fixed point, the fret forming the fixed point never moves regardless of the neck movement, thereby not changing the tone of guitar. This structure can sustain impact from any directions.

Furthermore, a guitar having the neck angle adjustment apparatus of the invention can be transported and maintained in an easy and convenient way since the neck and the main body can be simply assembled to or disassembled from each other.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. An apparatus for adjusting a neck angle of a guitar, which includes a main body, a neck connected to one side of the main body, a head formed at an end portion of the neck, and a guitar string, the apparatus comprising:

a support block having a receiving groove into which the neck is inserted, the support block being installed inside a lateral plate at a position corresponding to an aperture formed at one side of the main body;

a reinforcing plate installed at bottom of the receiving groove of the support block, the reinforcing plate including a central plate, a fixed plate fixed to a front face of the support block, and a guide plate guiding rotating of the neck;

an adjustment device for adjusting angle of the neck, the adjustment device including an adjustment bolt inserted into an adjustment hole formed from the bottom of the support block to the reinforcing plate and a thread portion formed in the adjustment hole of the central plate of the reinforcing plate so as to be thread-fastened with the adjustment bolt; and a fixing device for fixing the neck, the fixing device including a fixing bolt inserted into a fixing hole formed from the bottom of the support block to the neck body and a fixing nut fixed inside the neck body and thread-fastened with the fixing bolt.

2. The apparatus according to claim 1, wherein the reinforcing plate and the guide plate are bent along a circumferential circle R about a fixed point.

3. The apparatus according to claim 1, wherein a fixed protrusion to be inserted into an insert groove of the neck is raised in the central plate of the reinforcing plate.

4. The apparatus according to claim 1, wherein a support member for supporting the neck is installed outside the lateral plate at a position corresponding to the aperture.

5. The apparatus according to claim 1, wherein a support plate is installed at the bottom face of the neck.

6. The apparatus according to claim 2, wherein a support plate is installed at the bottom face of the neck.

7. The apparatus according to claim 3, wherein a support plate is installed at the bottom face of the neck.

8. The apparatus according to claim 4, wherein a support plate is installed at the bottom face of the neck.

9. A guitar having a main body, a neck connected to one side of the main body, a head formed at an end portion of the neck, and a guitar string, the guitar comprising:

an adjustment hole formed in a back plate of the main body;

a hole plate installed inside the back plate at a position corresponding to the adjustment hole, the hole plate having a second adjustment hole at the center thereof; and a magnet installed inside the hole plate, wherein the adjustment hole is closed with a cover made of an iron plate.

* * * * *